US006607364B2

(12) United States Patent
Yokomachi et al.

(10) Patent No.: US 6,607,364 B2
(45) Date of Patent: Aug. 19, 2003

(54) PISTON COMPRESSOR AND METHOD OF PRODUCING THE SAME

(75) Inventors: Naoya Yokomachi, Kariya (JP); Tatsuya Koide, Kariya (JP); Junya Suzuki, Kariya (JP); Toshiro Fujii, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 202 days.

(21) Appl. No.: 09/882,923

(22) Filed: Jun. 15, 2001

(65) Prior Publication Data

US 2002/0021971 A1 Feb. 21, 2002

(30) Foreign Application Priority Data

Jun. 16, 2000 (JP) ..... 2000-181465

(51) Int. Cl.[7] ..... F04B 1/12
(52) U.S. Cl. ..... 417/269
(58) Field of Search ..... 417/269, 222.2; 91/499; 92/71; 62/228.5

(56) References Cited

U.S. PATENT DOCUMENTS 4,174,191 A 11/1979 Roberts
4,178,135 A 12/1979 Roberts
5,509,346 A 4/1996 Kumpf
5,782,219 A 7/1998 Frey et al.
5,795,139 A * 8/1998 Ikeda et al. ..... 417/269
5,947,698 A * 9/1999 Ikeda et al. ..... 417/269
6,092,996 A 7/2000 Obrist et al. ..... 417/269
6,283,012 B1 * 9/2001 Kato et al. ..... 92/155
6,289,785 B1 * 9/2001 Ikeda et al. ..... 92/71
6,364,629 B1 * 4/2002 Shintoku et al. ..... 417/269
6,402,483 B1 * 6/2002 Kawamura et al. ..... 417/269
6,520,748 B2 * 2/2003 Yokomachi et al. ..... 417/222.2

FOREIGN PATENT DOCUMENTS

JP 10-306773 11/1998 ..... F04B/27/10

* cited by examiner

*Primary Examiner*—Teresa Walberg
*Assistant Examiner*—Vinod D. Patel
(74) *Attorney, Agent, or Firm*—Morgan & Finnegan, LLP

(57) ABSTRACT

A piston compressor includes a front housing member and a rear housing member. A suction chamber and a discharge chamber are defined either in the front housing member or in the rear housing member. A cylinder block is accommodated in a space defined by the front housing member and the rear housing member to be isolated from ambient air. Cylinder bores are defined in the cylinder block. Pistons are accommodated in the cylinder bores. A drive shaft is connected to each piston and is supported by the cylinder block. The front housing member and the rear housing member are connected with each other, and the cylinder block is fixed to one of the housing members. The compressor is sealed in an improved manner.

8 Claims, 3 Drawing Sheets

PISTON COMPRESSOR AND METHOD OF PRODUCING THE SAME

BACKGROUND OF THE INVENTION

The present invention relates to a piston compressor in which pistons reciprocate in the axial direction of a drive shaft and also to a process for producing the compressor.

Generally, a piston compressor has a cylinder block containing cylinder bores and a pair of housing members arranged on each side of the cylinder block. Each cylinder bore houses a piston for compressing a refrigerant. A suction chamber and a discharge chamber through which the refrigerant passes are defined in one of the housing members. A crank chamber in which a crank mechanism is located is defined in the other housing member. The crank mechanism reciprocates pistons based on rotation of the drive shaft.

Interfaces between the cylinder block and each housing member are exposed to the air. The interfaces increase the likelihood that fluid such as the refrigerant in the housing members will leak.

There is a proposed for reducing fluid leakage; that is, to reduce the number of interfaces, or junctions. For example, Japanese Unexamined Patent Publication No. Hei 10-306773 discloses an apparatus where a cylinder block 101 is located in a space defined by a front housing member 102 and a rear housing member 103, as shown in FIG. 4. According to this apparatus, there is only one junction 104 exposed to the air between the housing member 102 and 103, and thus leakage of the fluid in the space defined between them can be reduced.

However, the cylinder block 101 is located in the space, after the housing members 102 and 103 are combined with each other. When the housing members 102 and 103 are combined with each other in a compressor assembly, the cylinder block 101, the crank mechanism, the pistons, drive shafts and other elements that move relative to one another need be arranged so that they can operate. This makes the assembly extremely difficult and reduces productivity by a wide margin.

The above publication also discloses another apparatus, in addition to that shown in FIG. 4, in which the cylinder block is housed in the crank chamber. However, since the junction between the housing members is adjacent to the suction chamber and the discharge chamber, chambers cannot be sealed fully.

BRIEF SUMMARY OF THE INVENTION

It is an object of the present invention to provide a piston compressor which can achieve secured sealing between housing members and which can improve productivity.

In order to attain the above objective, the present invention provides the following piston compressor. The piston compressor comprises a front housing member and a rear housing member connected to the front housing member. A suction chamber and a discharge chamber are defined either in the front housing member or in the rear housing member. A cylinder block is accommodated in a space defined by the front housing member and the rear housing member and isolated from ambient air. The cylinder block is fixed to one of the housing members. Cylinder bores are defined in the cylinder block. Pistons are accommodated in the cylinder bores to reciprocate therein, respectively. A drive shaft drives the piston. The drive shaft is supported by the cylinder block. Fluid is compressed and discharged due to reciprocation of the piston.

The present invention also provides a process for producing a piston compressor. The process for producing a piston compressor. The process comprises connecting a drive shaft to a piston, supporting the piston by a cylinder block, accommodating the piston in a cylinder bore which is formed in the cylinder block, preparing a front housing member and a rear housing member. A suction chamber and a discharge chamber are formed either in the front housing member and the rear housing member. The process has connecting the front housing member to the rear housing member when the cylinder block is fixed to one of the front housing member and the rear housing member. The cylinder block is accommodated in a space defined by the front housing member and the rear housing member and is isolated from ambient air.

Other aspects and advantages of the invention will become apparent from the following description, taken in conjunction with the accompanying drawings, illustrating by way of example the principles of the invention.

BRIEF DESCRIPTION OF SEVERAL VIEWS OF THE DRAWINGS

The invention together with the objects and advantages thereof, may best be understood by reference to the following description of the presently preferred embodiments together with the accompanying drawings in which.

DETAILED DESCRIPTION OF THE PREFERRED EMBODIMENTS

The present invention will be described below by way of a first embodiment referring to FIG. 1. The right end and the left end in FIG. 1 are referred to the rear end and front end, respectively.

Figure 1:
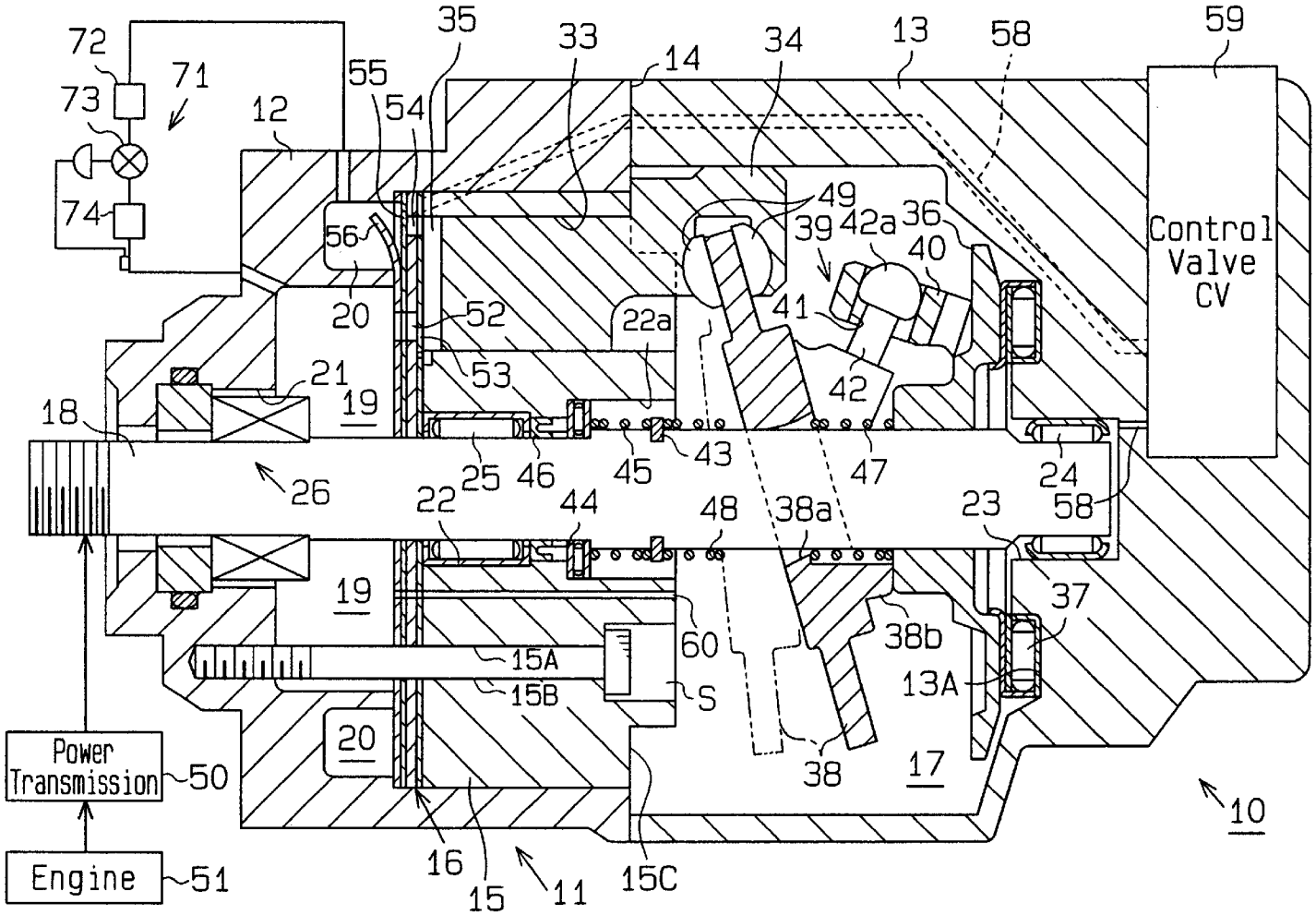
FIG. 1 is a cross-sectional view of the compressor according to a first embodiment of the present invention.

As shown in FIG. 1, a housing 11 of a compressor 10 has a front housing member 12 and a rear housing member 13. The front housing member 12 and the rear housing member 13 are held together by a plurality of through bolts (not shown). A sealing member (not shown) is applied to a junction 14 between the front housing member 12 and the rear housing member 13. This sealing member seals a space defined by the two housing members 12 and 13.

A cylinder block 15 is located in the space and is inserted in the front housing member 12. The cylinder block 15 is located such that the rear end 15*c* thereof is substantially in alignment with the junction 14, and a majority of the cylinder block 15 is housed in the front housing member 12.

A valve plate 16 is located between the front housing member 12 and the cylinder block 15. The cylinder block 15 has a plurality of through holes 15A (only one through hole is shown in FIG. 1). A bolt 15B is inserted in each through hole 15A from the rear side of the cylinder block 15 to penetrate the valve plate 16. The tip of each bolt 15B is engaged with a female thread formed in the front wall of the front housing member 12. The cylinder block 15 and the valve plate 16 are fastened by the bolts 15B to the front housing member 12. In this fastened state, each bolt 15B is designed to be set within the space S and not exposed to the outside of the housing 11.

A crank chamber 17 is defined between the cylinder block 15 and the rear housing member 13. A front end of a drive shaft 18 protrudes from the front housing member 12, and a rear end thereof is located in the crank chamber 17. In this state, the drive shaft 18 is supported in the housing 11.

A suction chamber 19 is defined in the front housing member 12. A substantially annular discharge chamber 20 is defined radially outward of the suction chamber 19 to surround the suction chamber 19.

A first holding space 21 is defined in the front housing member 12 to oppose the valve plate 16. The cylinder block 15 has a through hole 22 connecting the crank chamber 17 to the suction chamber 19. The rear housing member 13 has a second holding space 23, which communicates with the crank chamber 17.

The drive shaft 18 passes through the through hole 22, the suction chamber 19 and the first holding space 21. The drive shaft 18 is supported by the cylinder block 15 and the rear housing member 13 by a radial bearing 24 located in the second holding space 23 and by a radial bearing 25 located in the through hole 22. A shaft sealing device 26 is located in the first holding space 21. The shaft sealing device 26 seals a gap between the drive shaft 18 and the first holding space 21.

A plurality of cylinder bores 33 (only one cylinder bore is shown in FIG. 1) are defined in the cylinder block 15 and arranged at equiangular intervals around the axis L of the drive shaft 18. A single-head piston 34 is housed in each cylinder bore 33. An opening of each cylinder bore 33 is closed by the valve plate 16. A compression chamber 35, the volume of which changes as the piston 34 reciprocates, is defined in each cylinder bore 33.

A lug plate 36 is fixed to the rear end of the drive shaft 18 within the crank chamber 17 to rotate integrally with the shaft 18. A first thrust bearing 37 is located between the lug plate 36 and the inner wall surface 13A of the rear housing member 13.

A swash plate 38 is located in the crank chamber 17. The swash plate 38 contains a through hole 38*a* through which the drive shaft 18 passes. A hinge mechanism 39 is located between the lug plate 36 and the swash plate 38. The hinge mechanism 39 includes a pair of supporting arms 40 (only one arm is shown) protruding from the lug plate 36, a guide hole 41 formed in each supporting arm 40 and a pair of guide pins 42 (only one guide pin is shown) fixed to the swash plate 38. The guide pins 42 have spherical heads 42*a* that engage with the guide holes 41, respectively. The swash plate 38 is connected to the lug plate 36 through the hinge mechanism 39. The hinge mechanism 39 rotates the swash plate 38 integrally with the lug plate 36 and the drive shaft 18. The hinge mechanism 39 also guides the swash plate 38 in the axial direction of the drive shaft 18 and permits inclination of the swash plate 38 with respect to the axis of the drive shaft 18. In this embodiment, the lug plate 36 and the hinge mechanism 39 function as an inclination angle limiter. The swash plate 38 has a counterweight 38*b* formed integrally therewith on an opposite side of the drive shaft 18 from the hinge mechanism 39.

An engaging ring (e.g., a circlip) 43 is fixed on the drive shaft 18 in a large-diameter portion 22*a* of the through hole 22. A second thrust bearing 44 is located in the large-diameter portion 22*a* of the through hole 22 and is fitted on the drive shaft 18. A first coil spring 45 is wound around the drive shaft 18 between the engaging ring 43 and the second thrust bearing 44. The first coil spring 45 urges the drive shaft 18 toward the inner wall surface 13A of the rear housing member 13.

A seal ring 46 is located between the outer periphery of the drive shaft 18 and the inner surface of the cylinder block 15 within the through hole 22. The seal ring 46 prevents the refrigerant in the crank chamber 17 from leaking through the through hole 22 into the suction chamber 19.

A second coil spring 47 is wound around the drive shaft 18 between the lug plate 36 and the swash plate 38. The second coil spring 47 urges the swash plate 38 toward the cylinder block 15 (i.e., in the direction in which the inclination angle of the swash plate 38 decreases).

A third coil spring 48 is wound around the drive shaft 18 between the swash plate 38 and the engaging ring 43. When the swash plate 38 is positioned at the maximum inclination angle (e.g., at the position indicated by the solid line in FIG. 1), the third coil spring 48 does not apply force to the swash plate 38. Meanwhile, when the swash plate 38 is shifted to the minimum inclination angle position (e.g., the position indicated by the dashed line in FIG. 1), the third coil spring 48 is compressed between the swash plate 38 and the engaging ring 43. Further, the third coil spring 48 urges the swash plate 38 away from the cylinder block 15 (i.e., the direction that the inclination angle of the swash plate increases) from the engaging ring 43.

Each piston 34 is connected to the periphery of the swash plate 38 through a pair of shoes 49. Thus, the rotational motion of the swash plate 38 caused by the rotation of the drive shaft 18 is converted through the shoes 49 into reciprocation of each piston 34.

The drive shaft 18 is driven by an engine 51 or external drive source through a power transmission mechanism 50. The power transmission mechanism 50 may be a clutch mechanism (e.g., a solenoid clutch), which transmits or interrupts power according to external electrical control, or a normally power-transmitting type clutchless mechanism (e.g., a belt/pulley combination). In this embodiment, a clutchless power transmission mechanism 50 is employed.

In correspondence with each compression chamber 35, the valve plate 16 has a suction port 52, a suction valve 53 for opening and closing the suction port 52, a discharge port 54, and a discharge valve 55 for opening and closing the discharge port 54. A retainer 56 for defining the maximum valve travel of each discharge valve 55 is located in front of each discharge valve 55 of the valve plate 16. The retainer 56 is formed to curve into the discharge chamber 20. The suction chamber 19 communicates with the compression chambers 35 through the suction ports 52, respectively, while the compression chambers 35 communicate with the discharge chamber 20 through the discharge ports 54. During movement of a piston 34 from the top dead center to the bottom dead center, the refrigerant in the suction chamber 19 is drawn into the compression chamber 35 through the suction port 52 and the suction valve 53. During movement of the piston 34 from the bottom dead center to the top dead center, the refrigerant in the compression chamber 35 is compressed to a predetermined pressure and is discharged through the discharge port 54 and the discharge valve 55 into the discharge chamber 20.

A gas supply passage 58 is defined through the front housing member 12 and the rear housing member 13 to secure communication between the crank chamber 17 and the discharge chamber 20. A control valve 59 is located in the gas supply passage 58. The control valve 59 changes the opening degree of the passage 58.

A bleed passage 60 is defined through the cylinder block 15 and the valve plate 16 to connect the crank chamber 17 with the suction chamber 19.

The suction chamber 19 and the discharge chamber 20 are connected to each other through an external refrigerant circuit 71. The external refrigerant circuit 71 includes a condenser 72, an expansion valve 73 and an evaporator 74. The external refrigerant circuit 71 and the compressor 10 form a refrigerant circuit of a vehicular air conditioning system. In this embodiment, carbon dioxide is used as the refrigerant.

The control valve 59 changes the opening degree of the air supply passage 58 based, for example, on a signal from a controller (not shown) to adjust the flow rate of the refrigerant supplied from the discharge chamber 20 to the crank chamber 17.

During assembly of the compressor 10, the cylinder block 15 is fastened, together with the valve plate 16, to the front housing member 12 with the bolts 15B and, in this state, the front housing member 12 is combined with the rear housing member 13. Leakage of fluid from the discharge chamber 20 to the crank chamber 17 through the gap between the valve plate 16 and the front housing member 12 is controlled by a sealing member (not shown) between the valve plate 16 and the front housing member 12. Leakage of fluid from the crank chamber 17 into the suction chamber 19 through the gap between the through holes 15A and the bolts 15B is controlled by a sealing member (not shown) located between each through hole 15A and each bolt 15B.

Next, operation of the compressor having the constitution as described above will be described.

The swash plate 38 rotates integrally with the rotation of the drive shaft 18 through the lug plate 36 and the hinge mechanism 39. The rotational motion of the swash plate 38 is converted through the shoes 49 to reciprocating motion of the pistons. As each piston 34 reciprocates in the cylinder bore 33, the cycle of suction, compression and discharge of the refrigerant is repeated. The refrigerant supplied from the external refrigerant circuit 71 into the suction chamber 19 is drawn into the compression chamber 35 through the suction port 52. After the refrigerant is compressed, it is then discharged through the discharge ports 54 into the discharge chamber 20 and fed to the external refrigerant circuit 71.

A bleed passage 60 permits gas to flow out of the crank chamber 17 to the suction chamber 19. The valve position of the control valve 59 is adjusted depending on the cooling load to modify flow from the discharge chamber 20 to the crank chamber 17. When the flow rate of the refrigerant supplied to the crank chamber 17 decreases according to this modification, the pressure in the crank chamber 17 is reduced gradually. As a result, the difference between the pressure in the crank chamber 17 and that in the cylinder bore 33 decreases. Therefore, the swash plate 38 shifts to the maximum inclination angle position, and the stroke of the pistons 34 increases to increase the displacement.

When the flow rate of the refrigerant supplied from the discharge chamber 20 into the crank chamber 17 is increased to exceed the flow rate of the refrigerant flowing through the bleed passage 60 into the suction chamber 19, the pressure in the crank chamber 17 increases gradually. As a result, the difference between the pressure in the crank chamber 17 and that in the cylinder bore 33 increases. This causes the swash plate 38 to shift to the minimum inclination angle position, and the stroke of the piston 34 is reduced, which reduces the displacement.

This embodiment has the following effects.

The cylinder block 15 is located in a space defined between the front housing member 12 and the rear housing member 13 and isolated from the ambient air. The housing 11 has only one junction 14 between the two housing members 12 and 13. Thus, the number of junctions where leakage of the refrigerant in the housing 11 can occur can is reduced to improve sealing of the housing 11. Further, the reduced number of junctions reduces the number of sealing members to be applied to the junctions, which reduces costs. Since carbon dioxide, which serves as the refrigerant, must be highly compressed compared with chlorofluorocarbon (Freon) refrigerants, the present invention has significant effects.

The front housing member 12 and the rear housing member 13 are connected with each other, and the cylinder block 15 is fastened to the front housing member 12. This prevents the cylinder block 15 from slipping with respect to the front housing member 12, even if the front housing member 12 is tilted or vibrated during assembly of the compressor 10. That is, the combined front housing member 12 and cylinder block 15 unit has an increased freedom of position. The housing 11 must contain various moving parts, and this forces operators into deliberate assembling procedures while the moving parts are maintained in normal working positions. Under such circumstances, the increased freedom of position facilitates assembly. In other words, the productivity of compressors 10 can be increased by a wide margin.

Since the cylinder block 15 is fastened to the front housing member 12, the joint 14 between the housing members 12 and 13 can be spaced by a predetermined distance from the high-pressure discharge chamber 20. Thus, the junction 14 can be located on the crank chamber side of the cylinder block 15. The internal pressure of the crank chamber 17 is low compared with that of the discharge chamber 20, so that the pressure of the refrigerant acting upon the junction 14 is reduced compared with the case where the junction 14 is located on the discharge chamber side. Therefore, the fluid scarcely leaks through the junction 14 to the outside of the housing 11.

Since the pressure of the refrigerant acting upon the junction 14 is reduced, a sealing member for low-pressure application can be applied to the junction 14. This reduces costs.

The presence of the junction 14 on the crank chamber side reduces the length of the wall of the rear housing member 13 in the axial direction of the drive shaft 18, and the volume in the rear housing member 13 can be reduced compared with the case where the junction 14 is present in the vicinity of the suction chamber 19 and the discharge chamber 20. Thus, the sizes of dies for molding the rear housing member 13 are reduced. This reduces the difficulty finishing the inner surface of the peripheral wall.

The end 15C of the cylinder block 15 is arranged substantially in alignment with the junction 14. That is, the majority of the cylinder block 15 is housed in the front housing member 12. This increases the distance from the discharge chamber 20 and the suction chamber 19 to the junction 14 between the housing members 12 and 13 to further improve the sealing of the housing 11.

The discharge chamber 20 is defined radially outward of the suction chamber 19. This arrangement increases the volume of the suction chamber 19 and reduces the impact of pulsation, which occurs when refrigerant is drawn from the suction chamber 19 into the compression chambers 35.

For example, suppose that the front housing member 12 contains through holes into which bolts 15B are inserted from the front and that female threads are formed in the cylinder block 15 into which the bolts 15B are threaded, for fastening the cylinder block 15 to the front housing member 12. In this case, a gap between each through hole and each bolt 15B must be sealed for preventing leakage of refrigerant from the housing 11.

In this embodiment, the bolts 15B are housed within the space in the housing 11, and there is no need to form holes through the housing 11. Thus, the housing 11 is sealed in an improved manner compared with the case where the bolts 15B extend outside of the housing 11, and there is no need to use seals for the bolts 15B.

A second embodiment of the present invention will now be described referring to FIG. 2. A compressor 80 of this embodiment is the same as the compressor 10 in the first embodiment, except that the position of the cylinder block 15 shown in FIG. 1 and the manner of fixing it are modified. Therefore, elements common to the first embodiment shown in FIG. 1 have the same reference numbers in the drawing to avoid redundancy.

The cylinder block 15 extends into the front housing member 12 and the rear housing member 13. The cylinder block 15 is press fitted into the two housing members 12 and 13 and are fixed to them. The outer periphery of the cylinder block 15 contacts the inner peripheries of the housing members 12 and 13 to form a structure hardly permitting passage of a fluid such as a refrigerant. The through holes 15A and the bolts 15B used in the embodiment of FIG. 1 are omitted. Like in the first embodiment of FIG. 1, a sealing member (not shown) is applied to the junction 14, and the sealing member seals the space defined within the housing members 12 and 13.

The valve plate 16 is located between the cylinder block 15 and the rear housing member 13. The crank chamber 17 is defined between the cylinder block 15 and the front housing member 12.

The rear end of the drive shaft 18 is located in the through hole 22 defined in the cylinder block 15. The first holding space 21 is formed in the front housing member 12 to communicate with the crank chamber 17. The suction chamber 19 is on the opposite side of the valve plate 16 from the through hole 22 and is isolated from the through hole 22. In this embodiment, since the drive shaft 18 does not extend into the suction chamber 19, the seal ring 46 present in the embodiment of FIG. 1 is omitted. The drive shaft 18 is supported by the front housing member 12, by the radial bearing 24, and by the radial bearing 25.

The lug plate 36 is fixed to the intermediate part of the drive shaft 18 within the crank chamber 17 to rotate integrally with the shaft 18. The first thrust bearing 37 is located between the lug plate 36 and the inner wall surface 12A of the front housing member 12.

The ring 43, which engages with the first coil spring 45, is fixed to the large-diameter portion 22*a* of the through hole 22. The first coil spring 45 urges the drive shaft 18 toward the inner wall surface 12A through the second thrust bearing 44.

The third coil spring 48 is wound around the drive shaft 18 between an engaging ring 81 fitted on the drive shaft 18 and the swash plate 38. When the swash plate 38 is positioned at the maximum inclination angle (e.g., at the position indicated by the dashed line in FIG. 1), the third coil spring 48 does not apply force to the swash plate 38. When the swash plate 38 is positioned at the minimum inclination angle (e.g., the position indicated by the solid line in FIG. 1), the third coil spring 48 urges the swash plate 38 in the direction in which the inclination angle increases, through the engaging ring 81.

The gas supply passage 58 between the crank chamber 17 and the discharge chamber 20 runs from the rear housing member 13 and through the cylinder block 15 and the valve plate 16.

In the assembly of the compressor 80, the front housing member 12 and the rear housing member 13 are combined with each other, and the cylinder block 15 is press fitted in one of the two housing members 12 and 13. For example, the cylinder block 15 is press fitted into the rear housing member 13 to sandwich the valve plate 16 between the cylinder block 15 and the rear housing member 13, and the cylinder block 15 and the valve plate 16 are fixed to the rear housing member 13. In this state, the front housing member 12 and the rear housing member 13 are combined with each other. A part of the cylinder block 15 is press fitted into the front housing member 12.

This embodiment has the following effects, in addition to those of the first embodiment.

The cylinder block 15 is fixed to the housing 11 by press fitting. Thus, the cylinder block 15 is fixed to the housing 11 without using extra fasteners such as bolts. Therefore, the number of parts is lower compared with the embodiments in which the cylinder block 15 is fixed using fixing members.

Since the cylinder block 15 and the housing 11 contact each other, a fluid such as refrigerant hardly passes through the press-fit portion between the cylinder block 15 and the housing 11. Therefore, the housing 11 is sealed securely, and a sealing member for lower-pressure application can be applied to the junction 14. This reduces costs.

The junction 14 is present at the press-fit portion of the cylinder block 15 and the housing members 12 and 13. The junction 14 is present neither in the crank chamber 17 nor in the discharge chamber 20, so that neither the internal pressure of the crank chamber nor that of the discharge chamber 20 acts directly upon the junction 14. This further ensures sealing of the housing 11. Further, a sealing member for still lower-pressure application can be applied to the junction 14, achieving further cost saving.

The above embodiment can be modified, for example, as follows.

The compressor may be of the double-headed piston type having a front cylinder block and a rear cylinder block on each side of the crank mechanism respectively, and double-headed pistons which reciprocate between the cylinder blocks.

The compressor may be of the fixed displacement type, in which the stroke of each piston 34 cannot be changed (fixed stroke type).

The compressor may be, for example, of the wobble type in which the lug plate is supported rotatably relative to the drive shaft to be able to wobble.

The refrigerant is not limited to carbon dioxide but may be, for example, a chlorofluorocarbon refrigerant.

The cylinder block 15 may not be arranged such that its crank mechanism side end is located substantially in alignment with the junction 14.

The suction chamber 19 may be located outer than the discharge chamber 20 with respect to the diameter of the drive shaft 18.

Fixing of the cylinder block 15 to the housing having the discharge chamber and the suction chamber defined therein (i.e., the front housing member 12 in the embodiment of FIG. 1, and the rear housing member 13 in the embodiment of FIG. 2) is not to be limited to bolting or press fitting but may be achieved by means of adhesive joining or welding. Otherwise, claws are formed on the housing 11, and the claws are deformed after the cylinder block 15 is inserted to the housing 11 to fix the cylinder block 15 against the housing 11 by caulking.

Figure 3:
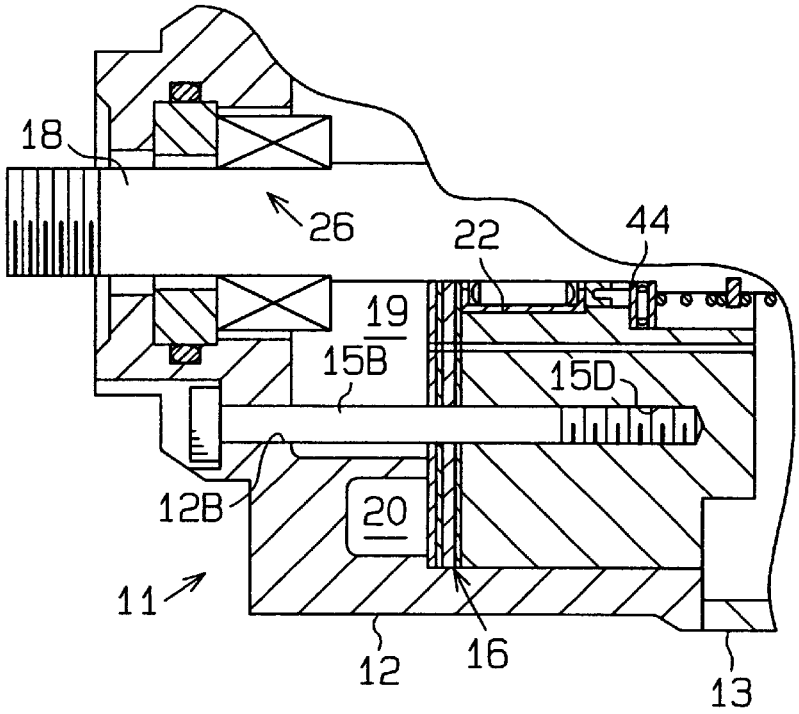
FIG. 3 is a partially cut-away cross-sectional view of the compressor according to a third embodiment of the present invention.
Figure 4:
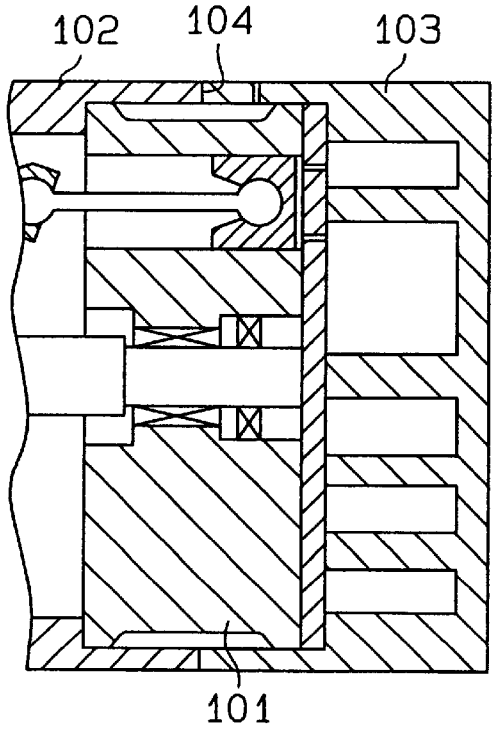
Fig.4(Prior Art)
FIG. 4 is a partially cut-away cross-sectional view of the compressor of the prior art.

In the embodiment of FIG. 1, the cylinder block 15 may be fastened to the front housing member 12 by inserting bolts 15B to the front housing member 12 from the outside. For example, as in the third embodiment shown in FIG. 3, through holes 12B are defined in the front wall of the front housing member 12. Female threads 15D that engage with the bolts 15B, respectively, are defined in the cylinder block 15. The bolts 15B are inserted through the holes 12B from the outside of the housing 11 and are threaded with the female threads 15D, respectively, to penetrate the valve plate 16. Thus the cylinder block 15 is fastened, together with the valve plate 16, to the front housing member 12.

In the embodiment of FIG. 1, the tip of each bolt 15B may protrude outside of the front housing member 12. For example, through holes are defined in the front housing member 12 to allow insertion of bolts 15B, and the bolts 15B are inserted from the inner space of the front housing member 12 through the holes 15A and through the holes of the front housing member 12 such that the tip of each bolt 15B protrudes outside of the front housing member 12. The tip of each bolt 15B protruding outside of the front housing member 12 is engaged with a nut or the like to fasten the cylinder block 15 to the front housing member 12. This eliminates the need for female threads in the front housing member 12.

In the embodiment of FIG. 1, the cylinder block 15 may be fastened to the housing members 12 and 13 by bolting. For example, female threads and through holes are defined in the cylinder block 15 and in the rear housing member 13, respectively. In the state where the cylinder block 15 is fastened to the front housing member 12 by the bolts 15B, the bolts 15B inserted from the outside of the rear housing member 13 through the holes and threaded with the female threads of the cylinder block 15, respectively. Thus, the front housing member 12 and the rear housing member 13 are fixed to each other with the cylinder block 15 is fixed both to the front housing member 12 and the rear housing member 13. In this case, a bolt used in the embodiment of FIG. 1 can be omitted.

In the embodiment of FIG. 1, a part of the cylinder block 15 may be housed in the rear housing member 13 so that this part can be press fitted into the rear housing member 13. In this case, the refrigerant in the crank chamber 17 hardly reaches the junction 14.

Figure 2:
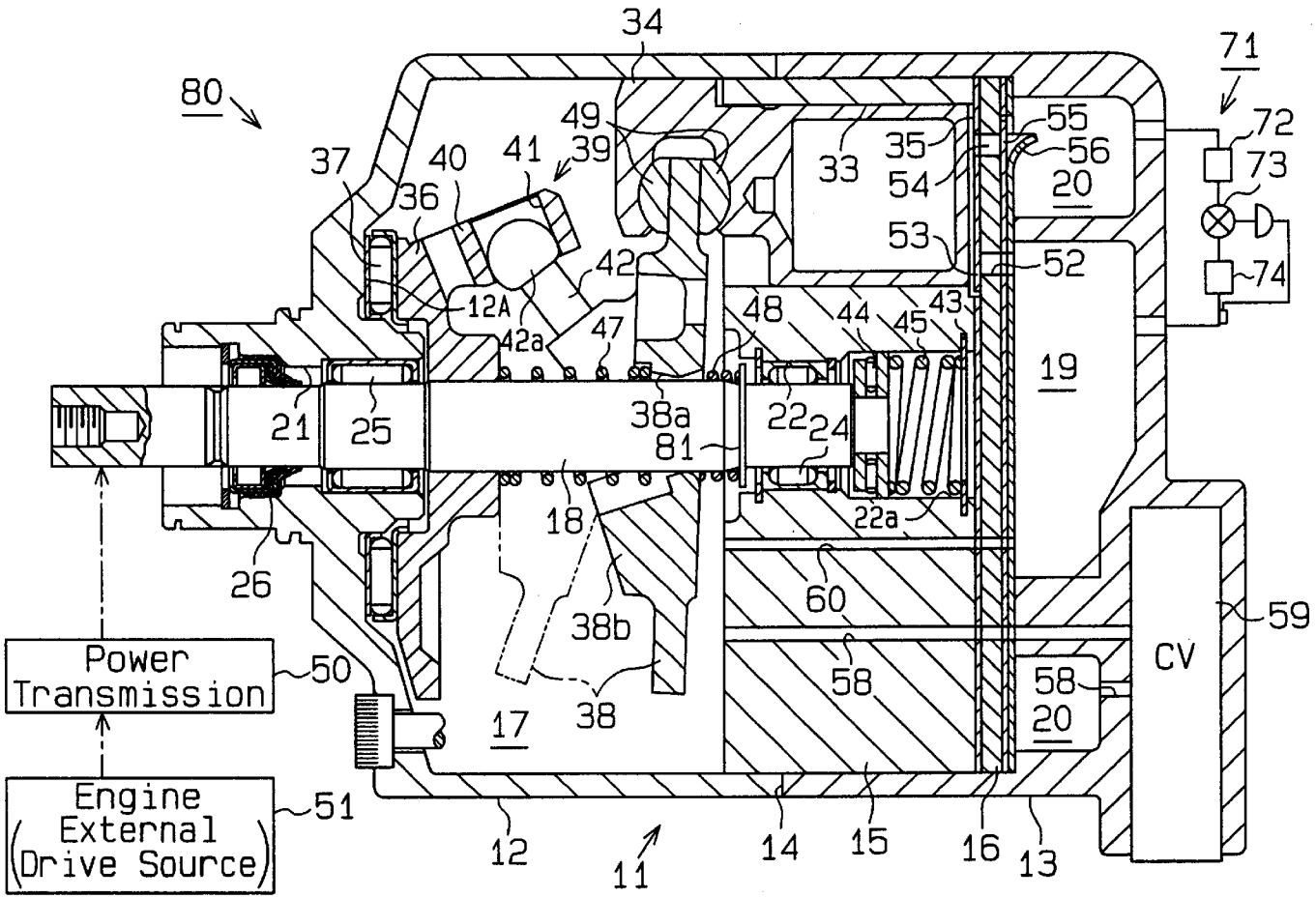
FIG. 2 is a cross-sectional view of the compressor according to a second embodiment of the present invention.

In the embodiment of FIG. 2, the junction 14 may not be present in the press-fit portion of the cylinder block 15 and the housing 11. In other words, the cylinder block 15 may not be press fitted into both of the front housing member 12 and the rear housing member 13. The cylinder block 15 may be press fitted into the rear housing member 13 only.

It should be apparent to those skilled in the art that the present invention may be embodied in many other specific forms without departing from the spirit or scope of the invention. Particularly, it should be understood that the invention may be embodied in the following forms.

Therefore, the present examples and embodiments are to be considered as illustrative and not restrictive, and the invention is not to be limited to the details given herein, but may be modified within the scope of the appended claims.

What is claimed is:

1. A piston compressor comprising:

a front housing member;

a rear housing member connected to the front housing member;

a suction chamber and a discharge chamber defined either in the front housing member or in the rear housing member;

a cylinder block accommodated in a space defined by the front housing member and the rear housing member and isolated from ambient air, wherein the cylinder block is fixed to one of the housing members;

cylinder bores defined in the cylinder block;

a piston accommodated in the cylinder bores to reciprocate therein, respectively; and a drive shaft for driving the piston, the drive shaft being supported by the cylinder block, wherein fluid is compressed and discharged due to reciprocation of the piston.

2. The piston compressor according to claim 1, wherein the front housing member and the rear housing member meet each other at a position spaced from the discharge chamber and the suction chamber by a distance substantially equal to the axial length of the cylinder block.

3. The piston compressor according to claim 1, wherein the discharge chamber is radially outward of the suction chamber.

4. The piston compressor according to claim 1, wherein the cylinder block is fastened with bolts to the housing in which the suction chamber and the discharge chamber are defined, and the heads of the bolts are located in a space defined by the front housing member and the rear housing member.

5. The piston compressor according to claim 1, wherein the cylinder block is press fitted into the housing member in which the suction chamber and the discharge chamber are defined.

6. A process for producing a piston compressor, the process comprising:

connecting a drive shaft to a piston;

supporting the piston by a cylinder block;

accommodating the piston in a cylinder bore which is formed in the cylinder block;

preparing a front housing member and a rear housing member, wherein a suction chamber and a discharge chamber are formed either in the front housing member and the rear housing member; and connecting the front housing member to the rear housing member when the cylinder block is fixed to one of the front housing member and the rear housing member, wherein the cylinder block is accommodated in a space defined by the front housing member and the rear housing member and is isolated from ambient air.

7. The process for producing a piston compressor according to claim 6, comprising fastening the cylinder block with bolts to the housing member in which the suction chamber and the discharge chamber are defined, and housing the heads of the bolts in the space.

8. The process for producing a piston compressor according to claim 6, comprising press fitting the cylinder block into the housing member in which the suction chamber and the discharge chamber are defined.

* * * * *